US011802016B2

(12) United States Patent
Takayasu

(10) Patent No.: US 11,802,016 B2
(45) Date of Patent: Oct. 31, 2023

(54) SHEET GUIDE, SHEET CONVEYOR, LIQUID DISCHARGE APPARATUS, AND PRINTER

(71) Applicant: Masanori Takayasu, Ibaraki (JP)

(72) Inventor: Masanori Takayasu, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 17/474,499

(22) Filed: Sep. 14, 2021

(65) Prior Publication Data

US 2022/0106141 A1 Apr. 7, 2022

(30) Foreign Application Priority Data

Oct. 1, 2020 (JP) ..... 2020-166678

(51) Int. Cl.
*B65H 5/38* (2006.01)
*B65H 5/06* (2006.01)

(52) U.S. Cl.
CPC ..... *B65H 5/38* (2013.01); *B65H 5/062* (2013.01)

(58) Field of Classification Search
CPC ..... B65H 2404/7431; B65H 2404/612; B65H 2402/44; B65H 5/062; B65H 5/38; B65H 2404/6111; B65H 2404/44
See application file for complete search history.

(56) References Cited

U.S. PATENT DOCUMENTS

2010/0194027 A1* 8/2010 Takagi ..... G03G 21/1695 271/226
2010/0254740 A1* 10/2010 Murata ..... G03G 15/6579 399/401
2011/0140343 A1* 6/2011 Tanaka ..... B65H 5/26 271/226
2014/0354728 A1* 12/2014 Murata ..... B41J 11/002 347/16
2017/0101280 A1* 4/2017 Akai ..... H04N 1/0032
2018/0282093 A1* 10/2018 Matsui ..... B65H 5/062
2020/0183311 A1* 6/2020 Sakurai ..... G03G 15/235

FOREIGN PATENT DOCUMENTS

JP 5-286188 11/1993
JP 2001-253140 9/2001
JP 2011-246240 12/2011

* cited by examiner

*Primary Examiner* — Jennifer Bahls
(74) *Attorney, Agent, or Firm* — Harness, Dickey & Pierce, P.L.C.

(57) ABSTRACT

A sheet guide comprising a first straight portion in an upstream end of the sheet guide in a conveyance direction of a sheet, a curved portion having a curvature, the curved portion continued from the first straight portion in the conveyance direction, and a second straight portion continued from the curved portion in a downstream end of the sheet guide in the conveyance direction. The curved portion includes a pair of guide plates defining a conveyance path through which the sheet is guided, and a shape retention member retaining a part of the pair of guide plates in a curved shape, the shape retention member holding each end of the pair of guide plates in a direction orthogonal to the conveyance direction.

18 Claims, 6 Drawing Sheets

COMPARATIVE EXAMPLE

COMPARATIVE EXAMPLE

COMPARATIVE EXAMPLE

SHEET GUIDE, SHEET CONVEYOR, LIQUID DISCHARGE APPARATUS, AND PRINTER

CROSS-REFERENCE TO RELATED APPLICATIONS

This patent application is based on and claims priority pursuant to 35 U.S.C. § 119(a) to Japanese Patent Application No. 2020-166678, filed on Oct. 1, 2020, in the Japan Patent Office, the entire disclosures of which is hereby incorporated by reference herein.

BACKGROUND

Technical Field

Aspects of the present disclosure relate to a sheet guide, a sheet conveyor, a liquid discharge apparatus, and a printer.

Related Art

A large-sized printer includes a turn portion to change a conveyance direction of a sheet to perform duplex printing. The turn portion is interposed at a position connecting a first linear portion and a second linear portion in a conveyance path of the sheet.

SUMMARY

In an aspect of this disclosure, a sheet guide comprising a first straight portion in an upstream end of the sheet guide in a conveyance direction of a sheet, a curved portion having a curvature, the curved portion continued from the first straight portion in the conveyance direction, and a second straight portion continued from the curved portion in a downstream end of the sheet guide in the conveyance direction. The curved portion includes a pair of guide plates defining a conveyance path through which the sheet is guided, and a shape retention member retaining a part of the pair of guide plates in a curved shape, the shape retention member holding each end of the pair of guide plates in a direction orthogonal to the conveyance direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
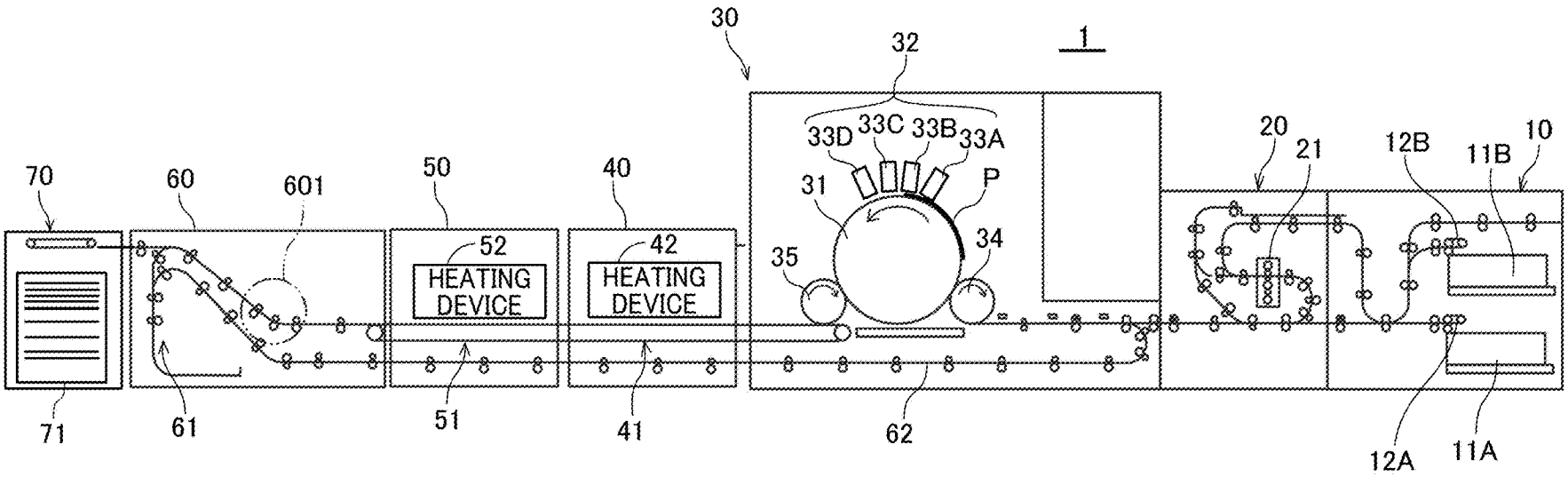
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

A printer 1 as a liquid discharge apparatus according to a first embodiment of the present disclosure is described with reference to FIGS. 1 and 2.

FIG. 1 is a schematic cross-sectional side view of the printer 1 according to the first embodiment of the present disclosure.

Figure 2:
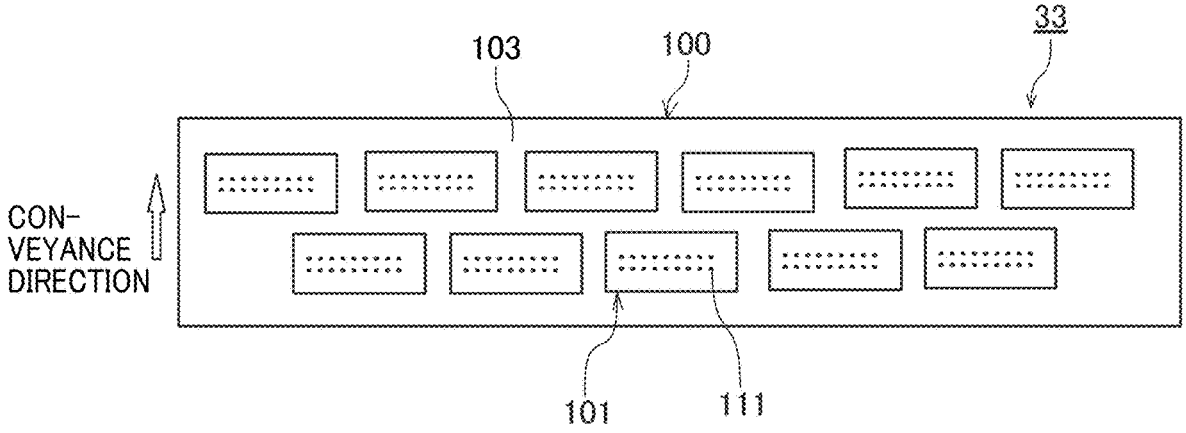
FIG. 2 is a plan view of a discharge unit of the printer.

FIG. 2 is a schematic plan view of a discharge unit 33 of the printer 1.

The printer 1 according to the first embodiment includes a loading unit 10 to load a sheet P into the printer 1, a pretreatment unit 20, a printing unit 30, a first dryer 40, a second dryer 50, a reverse mechanism 60, and an ejection unit 70. The pretreatment unit 20 serves as a liquid applier to apply a pretreatment liquid onto the sheet P.

In the printer 1, the pretreatment unit 20 applies, as desired, a pretreatment liquid as an application liquid onto the sheet P fed (supplied) from the loading unit 10, the printing unit 30 applies a desired liquid onto the sheet P to perform desired printing.

After the printer 1 dries the liquid adhering to the sheet P by the first dryer 40 and the second dryer 50, the printer 1 ejects the sheet P to the ejection unit 70 through the reverse mechanism 60 without printing on a back surface of the sheet P. The printer 1 may also print on both sides of the sheet P via the reversing mechanism 60 after the printer 1 dries the liquid adhering to the sheet P by the first dryer 40 and the second dryer 50, and the printer 1 then ejects the sheet P to the ejection unit 70.

The loading unit 10 includes loading trays 11 (a lower loading tray 11A and an upper loading tray 11B) to accommodate a plurality of sheets P and feeding units 12 (a feeding unit 12A and a feeding unit 12B) to separate and feed the sheets P one by one from the loading trays 11 and supply the sheets P to the pretreatment unit 20.

The pretreatment unit 20 includes, e.g., a coater 21 as a treatment-liquid application unit that coats a printing surface of the sheet P with a treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquids toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit 33 may discharge a special liquid, that is, a liquid of spot color such as white, gold, or silver.

As illustrated in FIG. 2, for example, each of the discharge unit 33 includes a head module 100 including a full line head. The head module 100 includes a plurality of liquid discharge heads 101 arranged in a staggered manner on a base 103. Each of the liquid discharge head 101 includes a plurality of nozzle rows, and a plurality of nozzles 111 is arranged in each of the nozzle rows. Hereinafter, the "liquid discharge heads 101" are simply referred to as a "head 101".

The discharge operation of each of the discharge unit 33 of the liquid discharge device 32 is controlled by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The drum 31 forwards the sheet P onto which a liquid is applied by the liquid discharge device 32 to the transfer cylinder 35. The transfer cylinder 35 forwards the sheet P fed from the drum 31 to a conveyor 41. The conveyor conveys the sheet P to the first dryer 40.

The first dryer 40 includes a heating device 42 such as an infrared (IR) heater. The heating device 42 irradiates the sheet P, onto which the liquid has been applied, with infrared rays to heat and dry the sheet P conveyed by the conveyor 41. The second dryer 50 includes a heating device 52 such as an ultraviolet (UV) ray irradiator. The heating device 52 of the second dryer 50 irradiates the sheet P, onto which the liquid has been applied, with ultraviolet rays to heat and dry the sheet P conveyed by a conveyor 51. The conveyor 41 and the conveyor 51 may include a part of same conveyance mechanism.

The reverse mechanism 60 includes a sheet guide 601 according to the first embodiment of the present disclosure to guide and convey the sheet P. The reverse mechanism 60 further includes a reverse part 61 and a duplex conveyor 62. The reverse mechanism 60 performs duplex printing on the sheet P, one surface of which has been applied with the liquid and has passed through the first dryer 40 and the second dryer 50 to dry said one surface. The reverse part 61 reverses the sheet P, and the duplex conveyor 62 feeds the sheet P to upstream of the transfer cylinder 34 of the printing unit 30 when the reverse mechanism 60 performs the duplex printing.

The ejection unit 70 includes an ejection tray 71 on which a plurality of sheets P is stacked. The plurality of sheets P conveyed from the reverse mechanism 60 is sequentially stacked and held on the ejection tray 71.

In the present embodiment, an example in which the sheet P is a cut sheet is described. However, the printer 1 according to the first embodiment of the present disclosure can also be applied to an apparatus using a continuous medium (web) such as continuous paper or roll paper, an apparatus using a sheet material such as wallpaper, and the like.

The sheet guide 601 according to the first embodiment of the present disclosure is described with reference to FIG. 3.

Figure 3A:
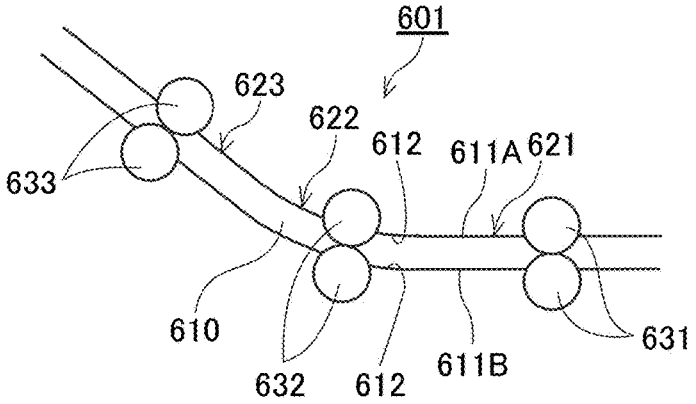
FIGS. 3A and 3B are schematic cross-sectional side views of a turn conveyance path (guide path) of a sheet guide according to the first embodiment of the present disclosure.
Figure 3B:
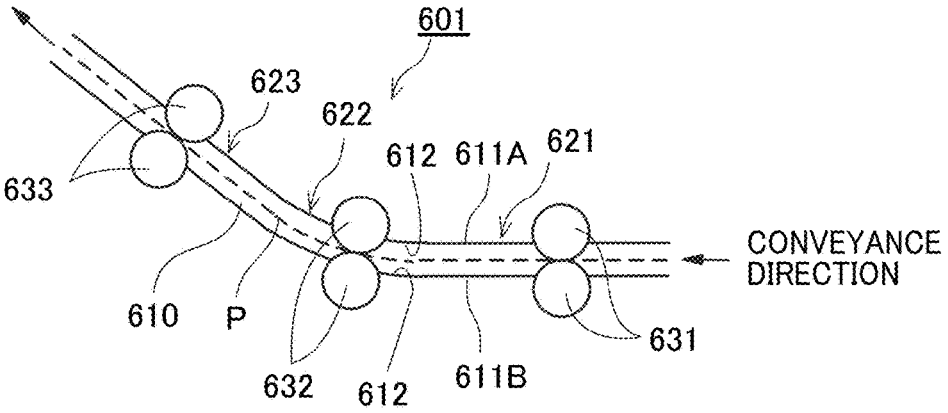

FIGS. 3A and 3B are schematic cross-sectional side views of the sheet guide 601.

FIG. 3A is a schematic cross-sectional side view of a turn conveyance path 610 (guide path).

FIG. 3B is a schematic cross-sectional side view of the turn conveyance path 610 in a state in which the sheet P passes through the conveyance path.

The sheet guide 601 includes the turn conveyance path 610 formed by guide plates 611 that includes an upper guide plate 611A and a lower guide plate 611B. Hereinafter, the upper guide plate 611A and the lower guide plate 611B may be collectively referred to as the "guide plate 611" or "a pair of guide plates 611".

The turn conveyance path 610 includes a first straight portion 621, a curved portion 622, and a second straight portion 623 from an upstream end (right end of the first straight portion 621 in FIG. 3A) to a downstream end (left end of the second straight portion 623 in FIG. 3A) in the conveyance direction (from right to left in FIG. 3A) of the sheet P as illustrated in FIG. 3A.

The turn conveyance path 610 does not have a specific changing point of a guide surface of the sheet P in the turn conveyance path 610. The curved portion 622 has an arc-shape and connects the first straight portion 621 and the second straight portion 623.

Thus, the sheet guide 601 can reduce a conveyance load due to contact between the guide surface in the turn conveyance path 610 and a leading end or a surface of the sheet P.

The sheet guide 601 includes pairs of conveyance rollers 631, 632, and 633 that nip the sheet P and rotate to convey (guide) the sheet P. Thus, the sheet guide 601 includes multiple rollers.

The conveyance rollers 631, 632, and 633 are disposed in the first straight portion 621, the curved portion 622, and the second straight portion 623, respectively. The pair of conveyance rollers 632 are conveyance rotating body disposed in the curved portion 622. Although the pair of conveyance rollers 632 is arranged at a center of the curved portion 622 in the conveyance direction, a position of the pair of conveyance rollers 632 is not limited the center of the curved portion 622.

Thus, the conveyance roller 631, 632, and 633 are disposed on the pair of guide plates 611A and 611B.

Thus, the sheet guide 601 can avoid contact between a print surface of the sheet P and a guide surface in the turn conveyance path 610. Thus, the sheet guide 601 can reduce a conveyance load due to contact between the sheet P and the sheet guide 601.

The sheet guide 601 includes A pair of guide plates 611 (611A and 611B) to form the conveyance path. The pair of guide plates 611A and 611B is configured to define the conveyance path 610 through which the sheet P is guided. Thus, the sheet P passes through an area between the pair of guide plates 611A and 611B facing each other so that the area between the pair of guide plates 611A and 611B defines the conveyance path 610.

Each of the guide plate 611 (611A and 611B) has a fine uneven surface defining an inner surface of the turn conveyance path 610 through which the sheet P is guided. For example, a steel plate having uneven surface such as a checker plate and embossed metal plate may be used to reduce a contact area between the sheet P and the guide plate 611. Thus, the sheet guide 601 can reduce the conveyance load due to contact between the sheet P and the sheet guide 601.

A comparative example is described below with reference to FIGS. 4A to 4C.

Figure 4A:
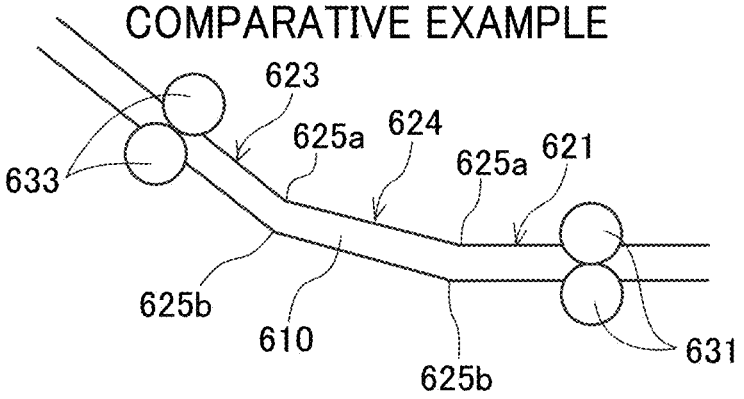
FIGS. 4A to 4C are schematic cross-sectional side views of the turn conveyance path (guide path) of the sheet guide in the comparative example.
Figure 4B:
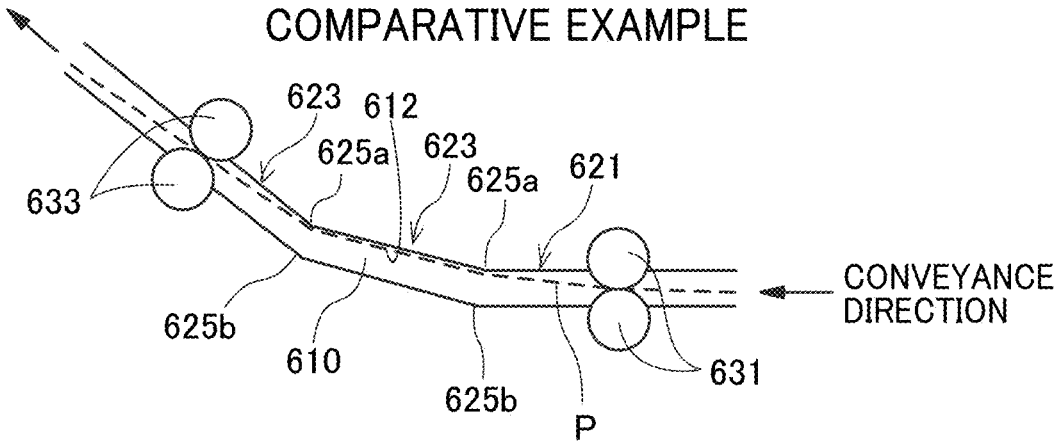
Figure 4C:
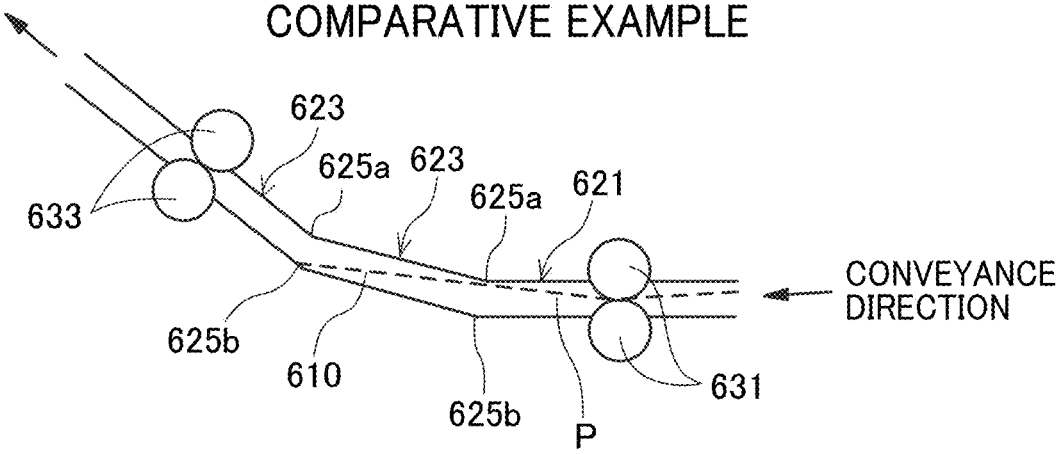

FIGS. 4A to 4C are schematic cross-sectional side views of the sheet guide 601 in the comparative example.

FIG. 4A is a schematic cross-sectional side view of the turn conveyance path 610 (guide path) of the comparative example.

FIGS. 4B and 4C are schematic cross-sectional side views of the turn conveyance path 610 in a state in which the sheet P passes through the turn conveyance path 610.

The turn conveyance path 610 in the comparative example includes a first straight portion 621, a third straight portion 624, and a second straight portion 623. The first straight portion 621, the third straight portion 624, and the second straight portion 623 are connected at an obtuse angle to form the turn conveyance path 610 that is virtually approximated to an arc.

An obtuse-angled convex portion 625*a* is formed on an upper inner surface of the turn conveyance path 610, and an obtuse-angled concave portion 625*b* is formed on a lower inner surface of the turn conveyance path 610 at each of a connecting portion between the first straight portion 621 and the third straight portion 624, and a connecting portion between the third straight portion 624 and the second straight portion 623.

Therefore, a print surface of the sheet P, on which the liquid is applied, comes into contact with the obtuse-angled convex portion 625*a* when the sheet P passes through the turn conveyance path 610 as illustrated in FIG. 4B. The obtuse-angled convex portion 625*a* is a specific change point of the guide surface 612. Thus, peeling of a printed image on the print surface of the sheet P is likely to occur.

Further, a paper jam may be occurred by a leading end of the sheet P contacting the obtuse-angled concave portion 625*b* when the sheet P passes through the turn conveyance path 610 as illustrated in FIG. 4C. The obtuse-angled concave portion 625*b* is another specific change point of the guide surface 612.

Conversely, the sheet guide 601 according to the first embodiment does not have specific change point in the turn conveyance path 610. Thus, the sheet guide 601 can stably convey the sheet P.

Next, an example of a specific configuration of the sheet guide 601 according to the first embodiment is described with reference to FIGS. 5 to 8.

Figure 5:
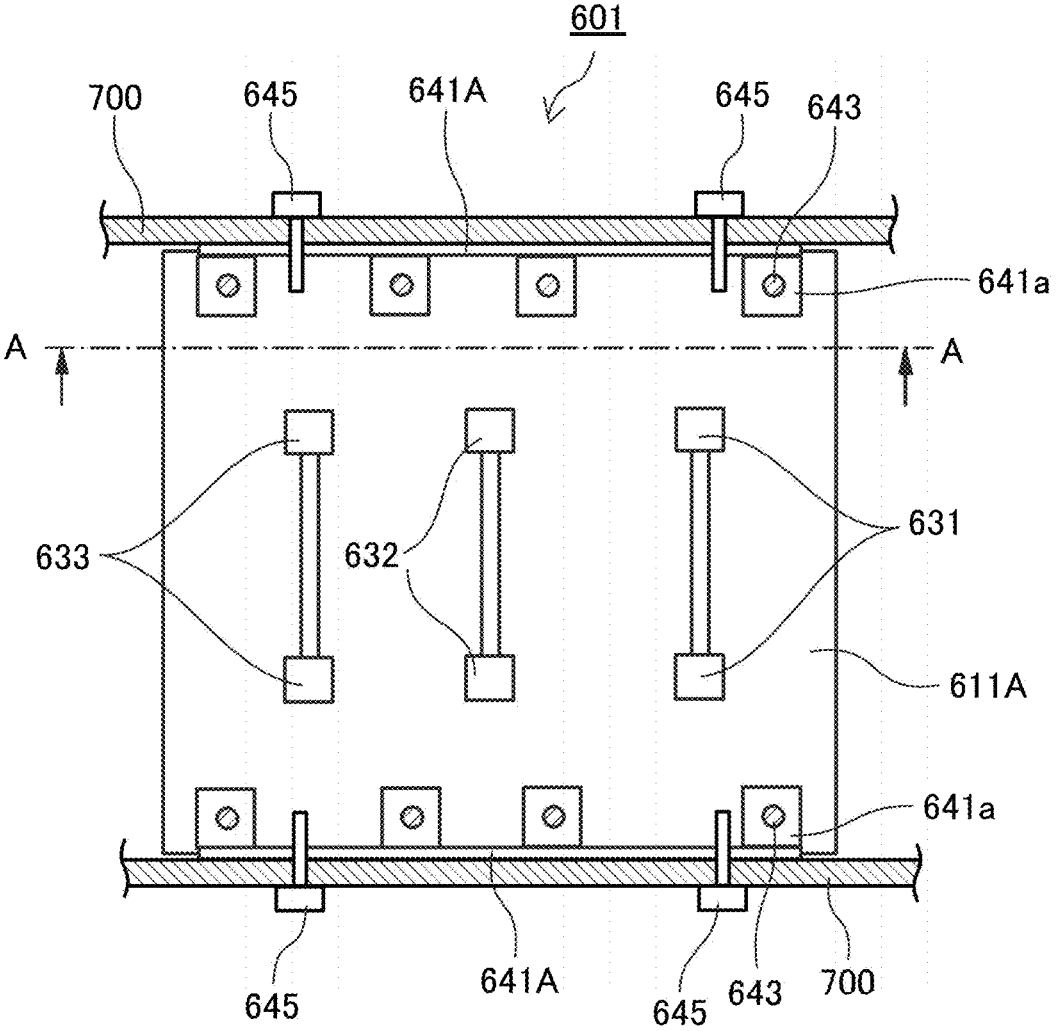
FIG. 5 is a schematic plan view of the sheet guide according to the first embodiment of the present disclosure.

FIG. 5 is a schematic plan view of the sheet guide 601 of the sheet conveyor (reverse mechanism 60) according to the first embodiment of the present disclosure.

Figure 6:
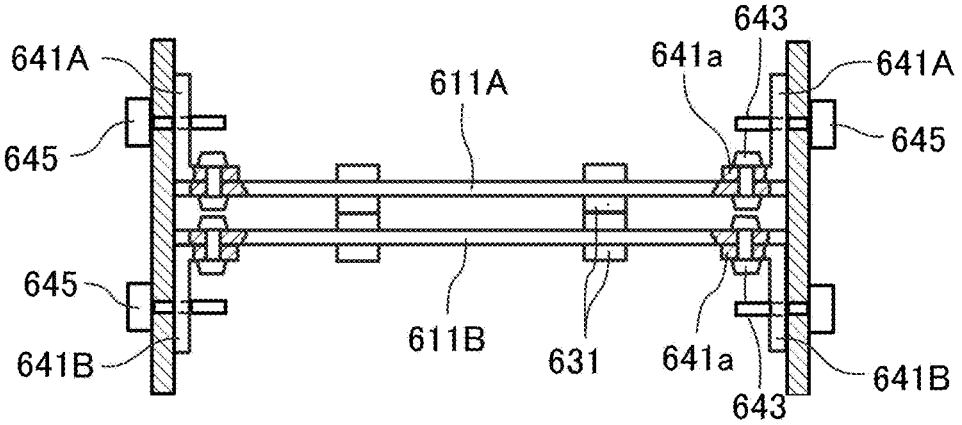
FIG. 6 is a schematic cross-sectional front view of the sheet guide according to the first embodiment of the present disclosure.

FIG. 6 is a schematic cross-sectional front view of the sheet guide 601 according to the first embodiment of the present disclosure.

Figure 7:
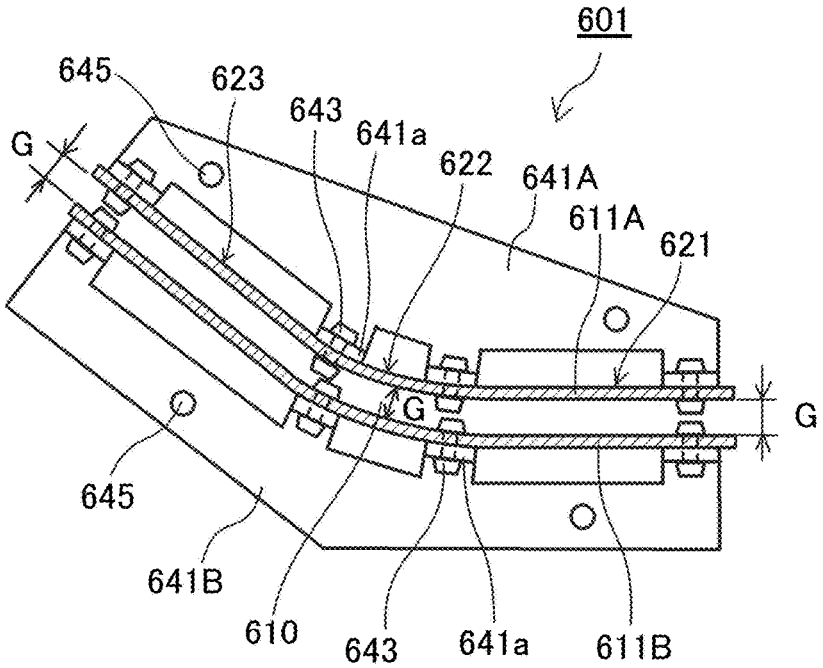
FIG. 7 is a cross-sectional view of the sheet guide along a line A-A of FIG. 5.

FIG. 7 is a cross-sectional view of the sheet guide 601 along a line A-A of FIG. 5.

Figure 8A:
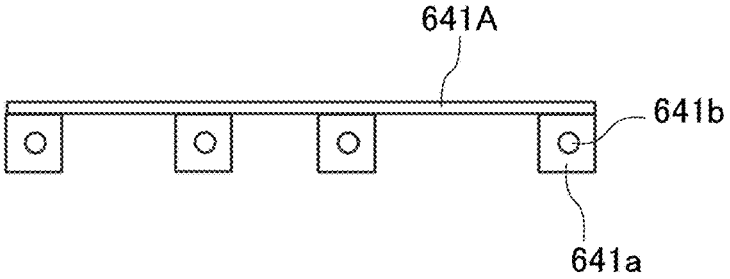
FIGS. 8A and 8B are a schematic front view and a plan view of a shape retention member, respectively.
Figure 8B:
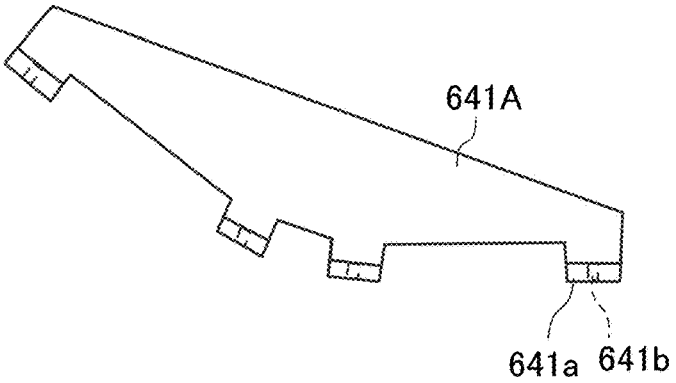

FIGS. 8A and 8B are a schematic front view and a plan view of a shape retention member, respectively.

The sheet guide 601 includes holders 641A and 641B to hold the guide plates 611A and 611B at a predetermined gap G. The holders 641A and 641B also serve as shape retention members that hold (retain) a part of the guide plates 611A and 611B corresponding to the curved portion 622 of the guide plates 611A and 611B in a curved shape.

Hereinafter, the holders 641A and 641B are collectively referred to as a "holder 641".

As illustrated in FIG. 6, the holders 641A hold the upper guide plate 611A, and the holders 641B hold the lower guide plate 611B.

The holder 641 includes flanges 641*a* to fix the guide plate 611 on an upstream end of the first straight portion 621, an upstream end and a downstream end of the curved portion 622, and a downstream end of the second straight portion 623 in the conveyance direction (from right to left) of the sheet P as illustrated in FIG. 7. Each of the flange 641*a* includes a rivet hole 641*b* as illustrated in FIGS. 8A and 8B.

The flange 641*a* of the holder 641 is fastened and fixed to an end of the guide plate 611 in a direction orthogonal to the conveyance direction with rivets 643. The rivets 643 are fasteners to fasten the flange 641*a* of the holder 641 to the guide plate 611.

The rivets 643 (fasteners) are configured to fasten the holders 641A and 641B (shape retention members) to the pair of guide plates 611A and 611B at an upstream end of the first straight portion 621 in the conveyance direction.

The rivets 643 (fasteners) are configured to fasten the holders 641A and 641B (shape retention members) to the pair of guide plates 611A and 611B at a downstream end of the second straight portion 623 in the conveyance direction.

Thus, the flange 641*a* retains (keeps) a curvature of the curved portion 622 of the guide plate 611 at a predetermined curvature.

The holder 641 is fastened and fixed to a frame 700 of an apparatus body of the sheet guide 601 of the reverse mechanism 60 by screws 645 in multiple places.

Thus, the holder 641 retains (keeps) a part of the guide plate 611 in a curved shape. The guide plate 611 forms a first straight portion 621, a curved portion 622 continued from the first straight portion 621, and a second straight portion 623 continued from the curved portion 622 to guide the sheet P.

Thus, the sheet guide 601 can reduce a conveyance load and an occurrence of a conveyance jam (paper jam) to stably guide (convey) the sheet P.

The sheet guide 601 according to a second embodiment of the present disclosure is described with reference to FIG. 9.

Figure 9:
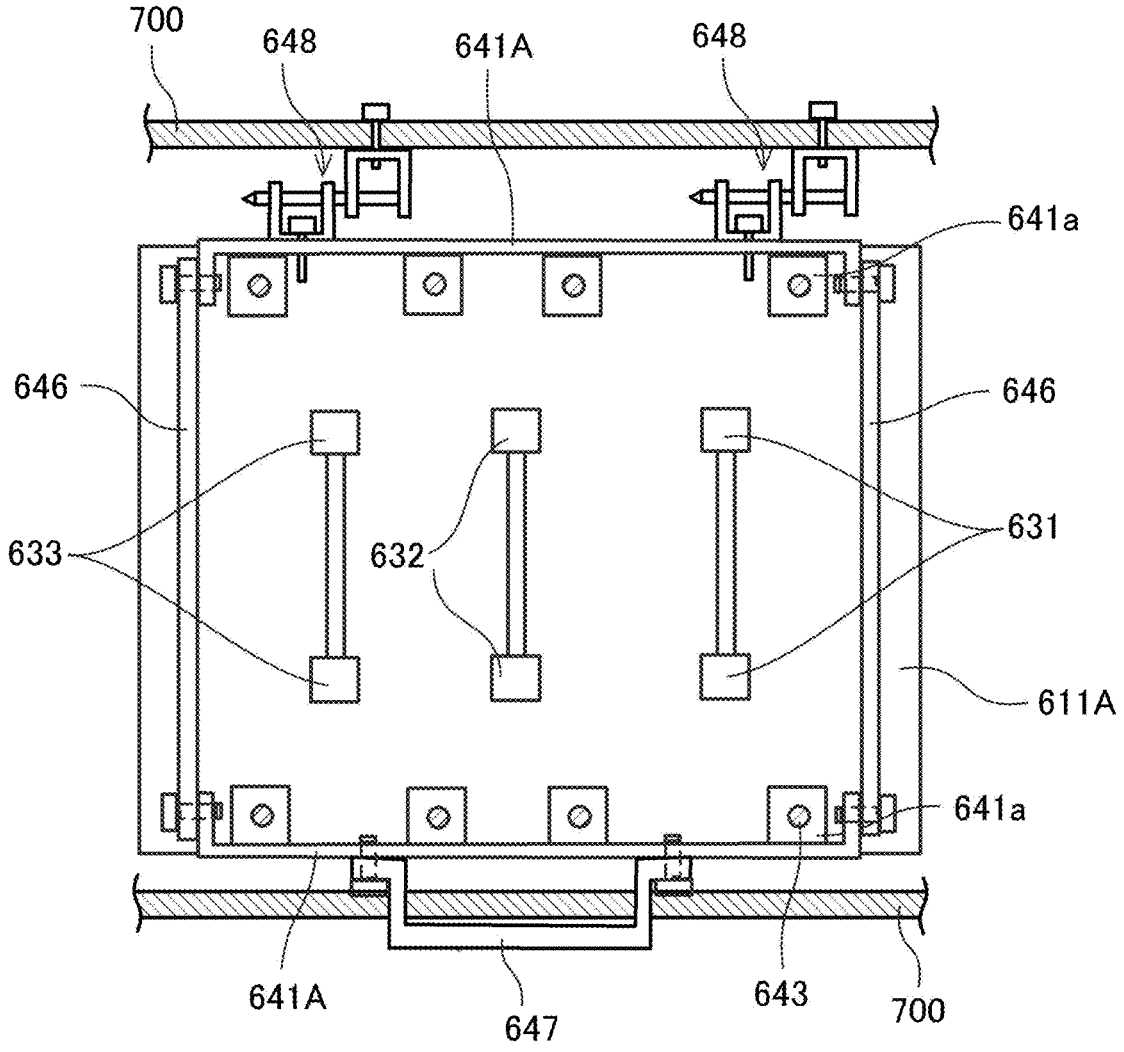
FIG. 9 is a schematic plan view of the sheet guide according to the second embodiment of the present disclosure.

FIG. 9 is a schematic plan view of the sheet guide 601 according to the second embodiment of the present disclosure.

The sheet guide 601 according to the second embodiment includes a front and rear holders 641 connected by connecters 646 such as a stay.

The sheet guide 601 according to the second embodiment further includes a handle 647 attached to a frond end (lower end in FIG. 9) of the holder 641A.

A rear end (upper end in FIG. 9) of the holder 641A is rotatably held by the frame 700 of the apparatus body of the sheet guide 601 of the reverse mechanism 60 via hinge mechanisms 648. The hinge mechanism 648 couples (connects) the frame 700 of the sheet guide 601 and the holder 641A (shape retention member).

Thus, the sheet guide 601 can open and close the upper guide plate 611A.

In each of the above-described embodiments, an example in which the present embodiment is applied to the turn conveyance path 610 of the reverse mechanism 60 of the printer 1 (liquid discharge apparatus) has been described. However, the turn conveyance path 610 (guide path) is not limited to the embodiments as described above.

In the present embodiments, a "liquid" discharged from the head is not particularly limited as long as the liquid has a viscosity and surface tension of degrees dischargeable from the head.

However, preferably, the viscosity of the liquid is not greater than 30 mPa-s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet guide comprising:

a first straight portion in an upstream end of the sheet guide in a conveyance direction of a sheet;

a curved portion having a curvature, the curved portion continued from the first straight portion in the conveyance direction;

a second straight portion continued from the curved portion and in a downstream end of the sheet guide in the conveyance direction;

a pair of guide plates defining a conveyance path through which the sheet is guided, a first portion of the pair of guide plates being included in the curved portion; and a shape retention member retaining a part of the pair of guide plates in a curved shape, the shape retention member holding each end of the pair of guide plates in a direction orthogonal to the conveyance direction, a first portion of the shape retention member being included in the curved portion, wherein the curved portion includes a pair of conveyance rollers configured to rotate to convey the sheet in the curved portion, and wherein the pair of conveyance roller are at a center of the curved portion in the conveyance direction.

2. The sheet guide according to claim 1, wherein each of the pair of conveyance rollers is disposed on one of the pair of guide plates.

3. The sheet guide according to claim 1, wherein the curved portion includes fasteners fastening the shape retention member to the pair of guide plates at an upstream end and a downstream end of the curved portion in the conveyance direction.

4. The sheet guide according to claim 1, wherein a second portion of the pair of guide plates is included in the first straight portion and a second portion of the shape retention member is included in the first straight portion, and the first straight portion includes fasteners fastening the shape retention member to the pair of guide plates at an upstream end of the first straight portion in the conveyance direction.

5. The sheet guide according to claim 4, wherein a conveyance roller configured to rotate to convey the sheet is disposed on each of the pair of guide plates in the first straight portion.

6. The sheet guide according to claim 1, wherein a second portion of the pair of guide plates is included in the second straight portion and a second portion of the shape retention member being included in the second straight portion, and the second straight portion includes fasteners fastening the shape retention member to the pair of guide plates at a downstream end of the second straight portion in the conveyance direction.

7. The sheet guide according to claim 6, wherein a conveyance roller configured to rotate to convey the sheet is disposed on each of the pair of guide plates in the second straight portion.

8. The sheet guide according to claim 1, wherein the pair of guide plates has an uneven surface defining an inner surface of the conveyance path through which the sheet is guided.

9. The sheet guide according to claim 1, wherein the curved portion includes a handle attached to the shape retention member.

10. The sheet guide according to claim 1, wherein the curved portion includes a hinge attached to the shape retention member and a frame of the sheet guide to couple the shape retention member and the frame, and the shape retention member is rotatably held by the frame of the sheet guide via the hinge.

11. A sheet conveyor comprising the sheet guide according to claim 1.

12. A liquid discharge apparatus comprising:

a liquid application device configured to discharge a liquid onto the sheet; and the sheet guide according to claim 1.

13. A printer comprising:

a printing unit configured to perform printing on the sheet; and the sheet guide according to claim 1.

14. A sheet guide comprising:

a pair of guide plates defining a conveyance path through which a sheet is guided in a conveyance direction such that the conveyance path includes a first straight portion, a curved portion and second straight portion, wherein the curved portion is between the first straight portion and the second straight portion;

a shape retention member retaining a part of the pair of guide plates in a curved shape, the shape retention member holding each end of the pair of guide plates in a direction orthogonal to the conveyance direction; and a plurality of conveyance rollers including a first conveyance roller, a second conveyance roller, a third conveyance roller, a fourth conveyance roller, a fifth conveyance roller and a sixth conveyance roller, the first conveyance roller being on a first guide plate of the pair of guide plates in the first straight portion, the second conveyance roller being on a second guide plate of the pair of guide plates in the first straight portion, the third conveyance roller being on the first guide plate in the curved portion, the fourth conveyance roller being on the second guide plate in the curved portion, the fifth conveyance roller being on the first guide plate in the second straight portion, the sixth conveyance roller being on the second guide plate in the second straight portion.

15. The sheet guide of claim 14, wherein the first conveyance roller is opposite the second conveyance roller in the conveyance path, the third conveyance roller is opposite the fourth conveyance roller in the conveyance path, and the fifth conveyance roller is opposite the sixth conveyance roller in the conveyance path.

16. The sheet guide of claim 14, wherein the third conveyance roller and the fourth conveyance roller are at a center of the curved portion.

17. The sheet guide of claim 14, wherein the shape retention member includes a first holder and a second holder, the first holder retaining a shape of the first guide plate by securing the first guide plate at an upstream end of the first guide plate and a downstream end of the first guide plate, the second holder retaining a shape of the second guide plate by securing the second guide plate at an upstream end of the second guide plate and a downstream end of the second guide plate.

18. The sheet guide of claim 17, wherein the first holder includes a plurality of first flanges, the first holder is fastened to the first guide plate via the plurality of first flanges, the second holder includes a plurality of second flanges, and the second holder is fastened to the second guide plate via the plurality of second flanges.

* * * * *